United States Patent [19]

Reeves

[11] 4,264,725

[45] Apr. 28, 1981

[54] PHOTOTHERMOGRAPHIC COMPOSITION AND PROCESS

[75] Inventor: John W. Reeves, Rochester, N.Y.

[73] Assignee: Eastman Kodak Company, Rochester, N.Y.

[21] Appl. No.: 80,376

[22] Filed: Oct. 1, 1979

Related U.S. Application Data

[63] Continuation-in-part of Ser. No. 952,863, Oct. 19, 1978, abandoned.

[51] Int. Cl.[3] ..... G03C 1/02

[52] U.S. Cl. ..... 430/619; 430/353; 430/620

[58] Field of Search ..... 430/620, 619, 617, 353

[56] References Cited

U.S. PATENT DOCUMENTS

| | | | |
|---|---|---|---|
| 2,563,791 | 8/1951 | Lowe | 430/569 |
| 3,480,436 | 11/1969 | Wilson | 430/522 |
| 3,666,477 | 5/1972 | Goffe | 430/619 |
| 3,761,270 | 9/1973 | de Mauriac et al. | 430/617 |
| 3,801,321 | 4/1974 | Evans et al. | 430/619 |
| 3,844,797 | 10/1974 | Willems et al. | 430/619 |
| 3,909,271 | 9/1975 | Ikenoue et al. | 430/619 |
| 4,080,211 | 3/1978 | Van Paesschen et al. | 430/935 |

FOREIGN PATENT DOCUMENTS

| | | | |
|---|---|---|---|
| 1422145 | 1/1976 | United Kingdom | 430/620 |

OTHER PUBLICATIONS

Product Licensing Index, vol. 92, Publ. 9232, Dec. 1971.

Research Disclosure, vol. 117, Item No. 11723, Jan. 1974.

Research Disclosure, vol. 170, Item No. 17029, Jun. 1978.

*Primary Examiner*—J. Travis Brown

*Attorney, Agent, or Firm*—Richard E. Knapp

[57] ABSTRACT

In a photothermographic silver halide composition capable of being coated on a support comprising a hydrophilic photosensitive silver halide emulsion containing a gelatino peptizer with an organic solvent mixture, a hydrophobic binder and an oxidation-reduction image-forming composition comprising (i) a silver salt of a long-chain fatty acid with (ii) an organic reducing agent, improvements are provided by a solvent mixture comprising a combination of (A) an alcohol photographic speed-increasing solvent which is a compound selected from the group consisting of benzyl alcohol photographic speed-increasing solvents and 2-phenoxyethanol speed-increasing solvents with (B) an aromatic hydrocarbon solvent that is compatible with the alcohol solvent and (C) 0 to 10% by weight of the solvent mixture of such hydrophobic binder. The described photothermographic composition can be prepared by very thoroughly mixing, such as ultrasonic wave mixing, (I) a hydrophilic photosensitive silver halide emulsion with (II) an organic solvent mixture comprising described (A), (B) and (C), and then very thoroughly mixing the resulting product with (III) comprising (a) a hydrophobic binder and (b) an oxidation-reduction image-forming composition comprising (i) a silver salt of a long-chain fatty acid with (ii) an organic reducing agent, typically in an organic solvent. The photothermographic composition can be coated on a suitable support to provide a photothermographic element.

26 Claims, No Drawings

PHOTOTHERMOGRAPHIC COMPOSITION AND PROCESS

This is a continuation-in-part application of U.S. Ser. No. 952,863 of John W. Reeves, filed Oct. 19, 1978, now abandoned.

BACKGROUND OF THE INVENTION

1. FIELD OF THE INVENTION

This invention relates to photothermographic silver halide materials as well as a method of preparing such materials. In one of its aspects it relates to a photothermographic silver halide composition capable of being coated comprising photosensitive silver halide and other components with a specific combination of solvents.

2. DESCRIPTION OF THE STATE OF THE ART

Photothermographic materials are well known in the photographic art. Photothermographic materials are also known as heat developable photographic materials. The photothermographic materials after imagewise exposure are heated to moderately elevated temperatures to produce a developed image in the absence of separate processing solutions or baths. The heat development can provide a developed silver image in the photothermographic material.

The term "material" as used herein, such as in photothermographic material, is intended to include elements and compositions. For instance, the use of "photothermographic material" is intended to refer to photothermographic element and photothermographic composition.

An example of a known photothermographic silver halide material comprises (a) a hydrophilic photosensitive silver halide emulsion containing a gelatino peptizer with (b) an organic solvent mixture, (c) a hydrophobic binder and (d) an oxidation-reduction image-forming composition comprising (i) a silver salt of a long-chain fatty acid, such as silver behenate or silver stearate, with (ii) an organic reducing agent, such as a phenolic reducing agent. It has been desirable to have hydrophilic photosensitive silver halide emulsion containing a gelatino peptizer in such a photothermographic material because of the higher photosensitivity of the silver halide emulsion and the ease of control in preparation of the emulsion based on conventional aqueous silver halide gelatino emulsion technology. A problem has been encountered in preparing such photothermographic silver halide materials. This problem involves the mixing of a hydrophilic photosensitive silver halide emulsion containing a gelatino peptizer with a composition, as described, containing hydrophobic components including a hydrophobic binder, such as poly(vinyl butyral), and a silver salt of a long-chain fatty acid, such as a silver salt of behenic acid. Typically, when a hydrophilic photosensitive silver halide emulsion containing a gelatino peptizer is mixed with such hydrophobic materials and then coated on a suitable support to produce a photothermographic element, the resulting photothermographic element produces a less than desired degree of photosensitivity, contrast and maximum density upon exposure and heat processing.

This problem has been encountered in photothermographic silver halide materials, as described in, for example, U.S. Pat. No. 3,666,477 of Goffe, issued May 30, 1972. Goffe proposed addition of alkylene oxide polymers and a mercaptotetrazole derivative to the photothermographic material to help provide increased photosensitivity.

In addition, a variety of organic solvents have been proposed in order to help prepare a photothermographic silver halide composition containing the described components. Such organic solvents that have been proposed include isopropanol, acetone, toluene, methanol, 2-methoxyethanol, chlorinated solvents, acetone-toluene mixtures and certain non-aqueous polar organic solvents. These solvents in photothermographic materials are described in, for example, U.K. Specifications Nos. 1,422,145; 1,460,868; and 1,354,186. The described individual solvents, such as isopropanol, have not provided the desired improved described properties. There has been a continuing need to provide improved relative speed and contrast with desired maximum image density.

SUMMARY OF THE INVENTION

It has been found according to the invention that the described advantages are provided in a photothermographic silver halide composition capable of being coated on a support comprising a hydrophilic photosensitive silver halide emulsion containing a gelatino peptizer with an organic solvent mixture, a hydrophobic binder and an oxidation-reduction image-forming composition comprising (i) a silver salt of a long-chain fatty acid with (ii) an organic reducing agent wherein the solvent mixture comprises a combination of (A) an alcohol photographic speed-increasing solvent which is a compound selected from the group consisting of benzyl alcohol photographic speed-increasing solvents and 2-phenoxyethanol speed-increasing solvents, (B) an aromatic hydrocarbon solvent that is compatible with the benzyl alcohol solvent. An especially useful organic solvent mixture as described comprises (C) a minor portion, that is up to 10%, typically about 3 to about 8%, by weight of the mixture, of the hydrophobic binder, such as poly(vinyl butyral).

A photothermographic composition according to the invention can be prepared by very thoroughly mixing, such as by ultrasonic wave mixing, (I) a hydrophilic photosensitive silver halide emulsion with (II) an organic solvent mixture comprising (A) an alcohol photographic speed-increasing solvent with (B) an aromatic hydrocarbon solvent that is compatible with the alcohol solvent and (C) 0 to 10%, typically about 3 to about 8%, by weight of said organic solvent mixture of a hydrophobic binder, such as poly(vinyl butyral) and then very thoroughly mixing the resulting product with (III) comprising (a) a hydrophobic binder and (b) an oxidation-reduction image-forming composition comprising (i) a silver salt of a long-chain fatty acid with (ii) an organic reducing agent, typically in an organic solvent. A photothermographic element according to the invention can be prepared by coating the resulting photothermographic composition on a suitable support.

An image can be developed in the photothermographic element after exposure by merely heating the photothermographic element to moderately elevated temperatures.

DETAILED DESCRIPTION OF THE INVENTION

A variety of described alcohol photographic speed-increasing solvents is useful in the described solvent mixture. It is necessary that the described alcohol solvent be compatible with the described aromatic hydrocarbon solvent and other components in the photothermographic silver halide composition. Some alcohol solvents can be insufficiently soluble in the described composition to be useful, such as chloro, hydroxy and nitro substituted benzyl alcohols. Selection of an optimum alcohol solvent will depend upon such factors as the particular components of the photothermographic composition, the desired image, coating conditions, the particular aromatic hydrocarbon solvent, the particular photographic silver halide emulsion, and the concentration of the various components of the photothermographic composition. Combinations of alcohol solvents can be useful if desired. Selection of an optimum alcohol solvent can be carried out by a simple test in which the alcohol solvent is used in Example 1 in place of benzyl alcohol. If the results of the alcohol solvent selected are similar to those of Example 1, the alcohol solvent is considered to be at least satisfactory. The described alcohol photographic speed-increasing solvents can be selected from, for example, phenalkylols and phenoxyalkylols, in which the alkylol contains 1 to 4 carbon atoms, and in which the phenyl group is unsubstituted or substituted with lower alkyl, such as alkyl containing 1 to 4 carbon atoms, lower alkoxy, such as alkoxy containing 1 to 4 carbon atoms, fluorosubstituted lower alkyl or phenoxy.

The term "speed-increasing" as used herein with regard to the speed-increasing solvent is intended to mean that the alcohol solvent provides a higher relative speed compared to a similar photothermographic composition containing no alcohol solvent.

The described benzyl alcohol solvent can be substituted benzyl alcohol or can be benzyl alcohol which is substituted with a group which does not adversely affect the desired solvent or sensitometric properties produced by the benzyl alcohol derivative. Examples of substituents which do not adversely affect the desired properties include methyl, phenoxy, trifluoromethyl, methoxy and ethoxy. Unsubstituted benzyl alcohol is preferred.

A variety of aromatic hydrocarbon solvents is useful in the described solvent mixture with the described alcohol speed-increasing solvent. The aromatic hydrocarbon solvent must be compatible with the alcohol solvent and other components of the photothermographic composition without adversely affecting the desired solvent and sensitometric properties produced by the solvent mixture. The optimum aromatic hydrocarbon solvent can be selected based on such factors as the particular components of the photothermographic composition, the particular alcohol solvent, coating conditions for the photothermographic composition, the particular photosensitive silver halide emulsion and the like. Combinations of aromatic hydrocarbon solvents can be useful if desired.

Examples of useful aromatic hydrocarbon solvents include toluene, xylene and benzene. Toluene is preferred as a solvent with benzyl alcohol.

Other solvents that are useful in place of or in combination with the described aromatic hydrocarbon solvents include butyl acetate, dimethyl acetamide and dimethylformamide. These solvents can be useful in combination if desired. However, an aromatic hydrocarbon solvent, such as toluene, is preferred with the described alcohol solvent, such as benzyl alcohol.

A range of concentration of described alcohol solvent is useful in the described photothermographic silver halide composition. Typically, the alcohol solvent is useful at a concentration which produces a photothermograhic element as coated containing the alcohol within the range of about 0.50 grams/$m^2$ to about 8.00 grams/$m^2$. An especially useful concentration of alcohol solvent, such as benzyl alcohol, is within the range of about 0.50 grams to about 1.50 grams of alcohol solvent/$m^2$ of support of the described photothermographic element. The optimum concentration of alcohol solvent will depend upon the particular components of the photothermographic material, coating conditions, desired image, the particular aromatic hydrocarbon solvent, the particular alcohol solvent and the like.

A range of concentration of aromatic hydrocarbon solvent is useful in the described photothermographic silver halide composition also. The concentration of aromatic hydrocarbon solvent is typically within the range of 30% to about 80% by weight of total photothermographic composition. A preferred concentration of aromatic hydrocarbon solvent, such as toluene, is within the range of about 45% to about 70% by weight of total photothermographic composition. The optimum concentration of aromatic hydrocarbon solvent will depend upon the described factors that relate to selection of the optimum concentration of described alcohol solvent.

A range of ratios of described alcohol solvent to aromatic hydrocarbon solvent is useful in the described solvent mixture at the time of mixing the solvent mixture with the silver halide. The photothermographic silver halide composition capable of being coated on a support according to the invention can comprise a concentration of the alcohol photograhic speed increasing solvent that is within the range of about 0.25 mole to about 2.0 moles of the alcohol solvent per mole of photosensitive silver halide in the emulsion. Typically, the ratio of alcohol solvent to aromatic hydrocarbon solvent at this point is within the range of about 1:4 to about 1:30. A preferred ratio of described alcohol solvent to aromatic hydrocarbon solvent is within the range of about 1:10 to about 1:25. An optimum ratio of alcohol solvent to aromatic hydrocarbon solvent will depend upon such factors as the particular solvents, the specific components of the photothermographic silver halide composition, coating conditions, the desired image, the particular silver halide emulsion and the like.

Typically, in the described photothermographic composition, that is prior to coating onto a suitable support, the ratio of alcohol solvent to hydrocarbon solvent is within the range of about 1:50 to 1:200 with a preferred range of 1:75 to 1:150.

The concentration of water in the photothermographic silver halide composition, as coated, should be no more than that which can be accomodated by the concentration of alcohol speed increasing solvent. The concentration of water in the photothermographic composition is typically no more than about 3% by weight of the composition. It is desirable to concentrate the photothermographic composition prior to coating in order to provide desired coating characteristics.

The photothermographic materials according to the invention comprise a photosensitive component which consists essentially of photosensitive silver halide. The photosensitive silver halide is in the form of a hydrophilic photosensitive silver halide emulsion containing a gelatino peptizer. The photosensitive silver halide is especially useful due to its high degree of photosensitivity compared to other photosensitive components. A typical concentration of hydrophilic photosensitive silver halide emulsion containing a gelatino peptizer in a photothermographic composition according to the invention is within the range of about 0.2 to about 1.0 mole of photosensitive silver halide per mole of the described silver salt of a long-chain fatty acid in the photothermographic material. Other photosensitive materials can be useful in combination with the described photosensitive silver halide if desired. Preferred photosensitive silver halides are silver chloride, silver bromoiodide, silver bromide, silver chlorobromoiodide or mixtures thereof. For purposes of the invention, silver iodide is also considered to be a photosensitive silver halide. A range of grain size of photosensitive silver halide from very coarse grain to very fine grain silver halide is useful. Very fine grain silver halide is typically preferred.

The hydrophilic photosensitive silver halide emulsion containing a gelatino peptizer can be prepared by any of the procedures known in the photographic art which involve the preparation of photographic silver halide gelatino emulsion. Useful procedures and forms of photosensitive silver halide gelatino emulsions for purposes of the invention are described in, for example, the *Product Licensing Index,* Volume 92, December 1971, Publication 9232 on page 107, published by Industrial Opportunities Limited, Homewell, Havant Hampshire, P09 1EF, UK. The photographic silver halide, as described, can be washed or unwashed, can be chemically sensitizied using chemical sensitization procedures and materials known in the photographic art, can be protected against the production of fog and stabilized against loss of sensitivity during keeping as described in the mentioned *Product Licensing Index* publication.

A hydrophilic photosensitive silver halide emulsion containing a gelatino peptizer which contains a low concentration of gelatin is often very useful. The concentration of gelatin which is very useful is typically within the range of about 9 to about 15 grams per mole of silver.

The term "hydrophilic" is intended herein to mean that the photosensitive silver halide emulsion containing a gelatino peptizer is compatible with an aqueous solvent.

The gelatino peptizer that is useful with the photosensitive silver halide emulsion can comprise a variety of gelatino peptizers known in the photographic art. The gelatino peptizer can be, for example, phthalated gelatin or non-phthalated gelatin. Other gelatino peptizers that are useful include acid or base hydrolyzed gelatins. A non-phthalated gelatin peptizer is especially useful with the described photosensitive silver halide emulsion.

The photosensitive silver halide emulsion can contain a range of concentration of the gelatino peptizer. Typically, the concentration of the gelatino peptizer is within the range of about 5 grams to about 20 grams of gelatino peptizer, such as gelatin, per mole of silver in the silver halide emulsion. This is described herein as a low-gel silver halide emulsion. An especially useful concentration of gelatino peptizer is within the range of about 9 to about 15 grams of gelatino peptizer per mole of silver in the silver halide emulsion. The optimum concentration of the gelatino peptizer will depend upon such factors as the particular photosensitive silver halide, the desired image, the particular components of the photothermographic composition, coating conditions, the particular benzyl alcohol solvent and the particular aromatic hydrocarbon solvent.

The silver halide emulsion pH can be maintained within a range of pH. Typically, the silver halide emulsion pH is maintained within the range of about 5.0 to about 6.2 during the emulsion precipitation step. Lower pH values may cause undesired coagulation and higher pH values may cause undesirable grain growth.

The temperature of the reaction vessel within which the silver halide emulsion is prepared is typically maintained within a temperature range of about 35° C. to about 75° C. during the composition preparation. The temperature range and duration of the preparation can be altered to produce the desired emulsion grain size and desired composition properties. The silver halide emulsion can be prepared by means of emulsion preparation techniques and apparatus known in the photographic art.

An especially useful method for preparation of the photothermographic composition is by a simultaneous double-jet emulsion addition of the components (I) and (II) into a jacket enclosing an ultrasonic means for exposing the composition to high frequency waves. After combination in the jacket and thorough mixing due to the ultrasonic waves, the mixture can be withdrawn and recirculated through the jacket enclosing the ultrasonic means for additional mixing or withdrawn immediately and combined readily with other addenda to produce the desired photothermographic composition.

A variety of hydrophobic binders is useful in the described photothermographic materials. The binders that are useful include various colloids alone or in combination as vehicles and/or binding agents. The hydrophobic binders which are suitable include transparent or translucent materials. Useful binders include polymers of alkylacrylates and methacrylates, acrylic acid, sulfoalkylacrylates or methacrylates, and those which have crosslinking sites that facilitate hardening or curing. Other useful hydrophobic binders include high molecular weight materials and resins, such as poly(vinyl butyral), cellulose acetate butyrate, poly(methyl methacrylate), poly(styrene), poly(vinyl chloride), chlorinated rubber, poly(isobutylene), butadiene-styrene copolymers, vinyl chloride-vinyl acetate copolymers, copolymers of vinyl acetate, vinyl chloride and maleic anhydride and the like. It is important that the hydrophobic binder not adversely affect the sensitometric or other desired properties of the described photothermographic material. Poly(vinyl butyral) is especially useful. This is available under the trade name "BUTVAR" from The Monsanto Company, U.S.A.

A range of concentration of hydrophobic binder can be useful in the photothermographic silver halide materials according to the invention. Typically, the concentration of hydrophobic binder in a photothermographic silver halide composition according to the invention is within the range of about 20 to about 65 mg/dm$^2$. An optimum concentration of the described binder can vary depending upon such factors as the particular binder, other components of the photothermographic material, coating conditions, desired image, processing temperature and conditions and the like.

If desired, a portion of the photographic silver halide in the photothermographic composition according to the invention can be prepared in situ in the photothermographic material. The photothermographic composition, for example, can contain a portion of the photographic silver halide that is prepared in or on one or more of the other components of the described photothermographic material rather than prepared separate from the described components and then admixed with them. Such a method of preparing silver halide in situ is described in, for example, U.S. Pat. No. 3,457,075 of Morgan et al., issued July 22, 1969.

The described photothermographic composition comprises an oxidation-reduction image-forming combination containing a long-chain fatty acid silver salt with a suitable reducing agent. The oxidation-reduction reaction resulting from this combination upon heating is believed to be catalyzed by the latent image silver from the photosensitive silver halide produced upon imagewise exposure of the photothermographic material followed by overall heating of the photothermographic material. The exact mechanism of image formation is not fully understood.

A variety of silver salts of long-chain fatty acids is useful in the photothermographic materials according to the invention. The term "long-chain" as used herein is intended to refer to a fatty acid containing 12 to 30 carbon atoms and which is typically resistant to darkening upon exposure to light. Useful long-chain fatty acid silver salts include, for example, silver stearate, silver behenate, silver caprate, silver hydroxystearate, silver myristate and silver palmitate. A minor proportion of another silver salt oxidizing agent which is not a long-chain fatty acid silver salt can be useful in combination with the silver salt of the long-chain fatty acid if desired. Such silver salts which can be useful in combination with the described silver salts of a long-chain fatty acid include, for example, silver benzotriazole, silver imidazole, silver benzoate and the like. Combinations of silver salts of long-chain fatty acids can be useful in the described photothermographic materials if desired.

A variety of organic reducing agents is useful in the described photothermographic silver halide materials according to the invention. These are typically silver halide developing agents which produce the desired oxidation-reduction image-forming reaction upon exposure and heating of the described photothermographic silver halide material. Examples of useful reducing agents include polyhydroxybenzenes, such as hydroquinone and alkyl substituted hydroquinones; catechols and pyrogallol; phenylenediamine developing agents; aminophenol developing agents; ascorbic acid developing agents, such as ascorbic acid and ascorbic acid ketals and other ascorbic acid derivatives; hydroxylamine developing agents; 3-pyrazolidone developing agents such as 1-phenyl-3-pyrazolidone and 4-methyl-4-hydroxymethyl-1-phenyl-3-pyrazolidone; hydroxytetronic acid and hydroxytetronamide developing agents; reductone developing agents; bis-$\beta$-naphthol reducing agents; sulfonamidophenol reducing agents and the like. Combinations of organic reducing agents can be useful in the described photothermographic silver halide materials. Sulfonamidophenol developing agents, such as described in Belgian Pat. No. 802,519 issued Jan. 18, 1974, can be especially useful in the photothermographic silver halide composition.

A range of concentration of the organic reducing agent can be useful in the described photothermographic silver halide materials. The concentration of organic reducing agent is typically within the range of about 5 mg/dm$^2$ to about 20 mg/dm$^2$, such as within the range of about 10 to about 17 mg/dm$^2$. The optimum concentration of organic reducing agent will depend upon such factors as the particular long-chain fatty acid, the desired image, processing conditions, the particular solvent mixture, coating conditions and the like.

The order of addition of the described components for preparing the photothermographic composition before coating the composition onto a suitable support is important to obtain optimum photographic speed, contrast and maximum density. In an especially useful method according to the invention the low-gel silver halide emulsion is added to an ultrasonic mixing means through one inlet and a solvent mixture containing toluene, up to about 10%, typically about 3% to about 8%, by weight poly(vinyl butyral) and benzyl alcohol is added through another inlet. The low-gel silver halide is dispersed thoroughly in this environment by ultrasonic waves. The resulting product is then combined with the remaining components of the desired photothermographic composition. If the low-gel silver halide is not dispersed as described before adding the other components, the silver halide grains in the composition have a tendency to clump together and precipitate to the bottom of the container in which the composition is mixed.

A variety of mixing means is useful for preparing the described compositions. However, the mixing means should be one which provides very thorough mixing, such as an ultrasonic mixing means. Other mixing means than ultrasonic mixing means that can be useful are commercially available colloid mill mixing means and dispersator mixing means known in the photographic art. A blender, such as a blender known under the trade name of "Waring" blender, does not produce the very thorough mixing that is desired in most cases.

It is desirable, in some cases, to have what is described as a toning agent, also known as an activator-toning agent, in the photothermographic material according to the invention. Combinations of toning agents can often be useful. Typical toning agents include, for example, phthalimide, succinimide, N-hydroxyphthalimide, N-hydroxy-1,8-naphthalimide, N-hydroxysuccinimide, 1-(2H)-phthalazinone and phthalazinone derivatives.

Photothermographic materials according to the invention can contain other addenda that are useful in imaging. Suitable addenda in the described photothermographic materials include development modifiers that function as speed-increasing compounds, hardeners, antistatic layers, plasticizers and lubricants, coating aids, brighteners, spectral sensitizing dyes, absorbing and filter dyes, matting agents and the like.

It is useful in certain cases to include a stabilizer in the described photothermographic material. This can help in stabilization of a developed image. Combinations of stabilizers can be useful if desired. Typical stabilizers or stabilizer precursors include certain halogen compounds, such as tetrabromobutane and 2-(tribromomethylsulfonyl, benzothiazole, which provide improved post-processing stability and azothioethers and blocked azoline thione stabilizer precursors.

The photothermographic elements according to the invention can comprise a variety of supports which can tolerate the processing temperatures useful in developing an image. Typical supports include cellulose ester, poly(vinyl acetal), poly(ethylene terephthalate), polycarbonate and polyester film supports. Related film and resinous support materials, as well as paper, glass, metal and the like supports which can withstand the described processing temperatures are also useful. Typically a flexible support is most useful.

The photothermographic compositions can be coated on a suitable support by coating procedures known in the photographic art including dip coating, airknife coating, curtain coating or extrusion coating using hoppers. If desired, two or more layers can be coated simultaneously.

The described silver halide and oxidation-reduction image-forming combination can be in any suitable location in the photothermographic element according to the invention which produces the desired image. In some cases it can be desirable to include certain percentages of the described reducing agent, the silver salt oxidizing agent and/or other addenda in a protective layer or overcoat layer over the layer containing the other components of the element as described. The components, however, must be in a location which enables their desired interaction upon processing.

It is necessary that the photosensitive silver halide, as described, and other components of the imaging combination be "in reactive association" with each other in order to produce the desired image. The term "in reactive association," as employed herein, is intended to mean that the photosensitive silver halide and the image-forming combination are in a location with respect to each other which enables the desired processing and produces a useful image.

A useful embodiment of the invention is a photothermographic silver halide composition capable of being coated on a support comprising (a) an aqueous photosensitive silver halide emulsion containing a gelatino peptizer with (b) an organic solvent mixture comprising a combination of a benzyl alcohol photographic speed-increasing solvent, such as benzyl alcohol, with toluene and up to 10% by weight poly(vinyl butyral), (c) a hydrophobic polymeric binder consisting essentially of poly(vinyl butyral) and (d) an oxidation-reduction image-forming combination comprising (i) a silver salt of a long-chain fatty acid consisting essentially of silver benhenate with (ii) an organic reducing agent consisting essentially of a sulfonamidophenol. This composition can be coated on a suitable support to produce a photothermographic element according to the invention. Another embodiment of the invention is a method of preparing a photothermographic element comprising coating the resulting composition onto a suitable support to produce a photothermographic element as desired.

A variety of imagewise exposure means is useful with the photothermographic materials according to the invention. The imaging means according to the invention can be any suitable source of radiation to which the photothermographic material is sensitive. The imaging materials according to the invention are typically sensitive to the ultraviolet and blue regions of the spectrum and exposure means which provide this radiation are preferred. Typically, however, if a spectral sensitizing dye or combination of spectral sensitizing dyes are present in the photothermographic material, exposure means using other ranges of the electromagnetic spectrum can be useful. Typically, a photothermographic material according to the invention is exposed imagewise with a visible light source, such as a tungsten lamp. Other sources of radiation can be useful and include, for instance, lasers, electron beams, X-ray sources and the like. The photothermographic materials are typically exposed imagewise to produce a developable latent image.

A visible image can be developed in the photothermographic material according to the invention within a short time, such as within several seconds, merely by heating the photothermographic material to moderately elevated temperatures. For example, the exposed photothermographic material can be heated to a temperature within the range of about 100° C. to about 200° C., such as a temperature within the range of about 110° C. to about 140° C. Heating is carried out until a desired image is developed, typically within about 2 to about 30 seconds, such as about 2 to about 10 seconds. Selection of an optimum processing time and temperature will depend upon such factors as the desired image, particular components of the photothermographic element, the particular latent image and the like.

A variety of means can be useful to produce the necessary heating of the described photothermographic material to develop the desired image. The heating means can be a simple hot plate, iron, roller, infrared heating means, hot air heating means or the like.

Processing according to the invention is typically carried out under ambient conditions of pressure and humidity. Pressures and humidity outside normal atmospheric conditions can be useful if desired; however, normal atmospheric conditions are preferred.

The following examples are included for a further understanding of the invention.

EXAMPLE 1

This illustrates the invention.

A silver behenate/behenic acid dispersion (C) was prepared by blending the following components:

| | | |
|---|---|---|
| acetone | 250 | ml |
| toluene | 250 | ml |
| poly(vinyl butyral) | 30.3 | g |
| behenic acid | 16.0 | g |
| silver behenate | 42.0 | g |

A silver halide gelatino photosensitive dispersion (Z) was prepared as follows: An aqueous solution of $10^{-3}$ molar lithium bromide was added to 0.02 mole of a 400 A° silver bromoiodide (6 mole % iodide) gelatino emulsion (40 grams non-phthalated gelatin per silver mole) to produce a total weight of 200 grams. The resulting mixture was stirred for 15 minutes at 40° C. and a pH of 6.1 with a pAg of 8.4. The emulsion was centrifuged for 20 minutes at 3000 rpm. The resulting supernatant was discarded and a 100 mg sample of the wet centrifuged silver halide emulsion was treated with ultrasonic waves for 30 seconds in the presence of 3 ml of a solvent mixture containing 87 grams of toluene, 4 grams of benzyl alcohol and 4% by weight poly(vinyl butyral).

This resulting silver halide dispersion (Z) was combined with the following components:

| | |
|---|---|
| acetone/toluene (1:9 parts by volume) solution containing 0.01% by weight 3-ethyl-2-thio-2,4-oxazolidinedione (speed-increasing addenda) | 0.15 ml |
| acetone/toluene (1:9 parts by volume) solution containing 0.01% by weight 3-ethyl-5-(3-ethyl-2-benzoxazolylideneethylidene)- | 0.50 ml |

-continued

| | | |
|---|---|---|
| 1-phenyl-2-thiohydantoin (sensitizing dye) | | |
| silver behenate dispersion C (described above) (oxidizing agent | 3.6 | ml |

The resulting composition was mixed by shaking for several minutes. The dispersion was combined with the following solutions and coated on an unsubbed poly-(ethylene terephthalate) film support at a 0.008 inch (8 mils) wet coating thickness:

| | | |
|---|---|---|
| acetone/toluene (1:1 parts by volume) solution containing 25% by weight 2,6-dichloro-4-benzenesulfonamidophenol (reducing agent) | 0.50 | ml |
| toluene solution containing siloxane surfactant (containing 2% by weight silicone AF-70, trademark of the General Electric Company) | 2 | drops |
| acetone solution containing 5% by weight 2-(tribromomethylsulfonyl)benzothiazole (stabilizer) | 0.30 | ml |

The resulting coating was dried at 48.9° C. for 5 minutes. This produced a photothermographic element according to the invention. The element was imagewise exposed to light through a 1.0 neutral density and a graduated density step wedge to produce a developable latent image in the photothermographic element. The resulting image was developed by heating the photothermographic element for 5 seconds at 140° C. A high contrast developed image was produced. The image had a maximum density above 3.8 and a minimum density of 0.12. The resulting photothermographic element was free from mottle and exhibited a smooth surface.

The resulting photothermographic element and its sensitometric properties compared favorably with a similarly prepared photothermographic element that contained silver halide having a similar grain size but which, in the absence of gelatin, had been formed in a poly(vinyl butyral) composition with an acetone solvent in place of the combination of benzyl alcohol and toluene.

EXAMPLE 2

This illustrates use of a phthalated gelatin peptized silver halide emulsion containing less than 9 grams of phthalated gelatin per mole of silver in a non-aqueous photothermographic material according to the invention.

A gelatino silver halide emulsion was prepared by adding following Solutions B and C simultaneously to following Solution A at the rate of 6.3 milliliters per minute.

| | | |
|---|---|---|
| Solution A | | |
| Phthalated gelatin | 9 | g |
| Distilled water | 783 | ml |
| Temperature 35° C. | | |
| pH 5.0 | | |
| VAg + 60 mv | | |
| Solution B | | |
| NaBr | 133.9 | g |
| KI | 4.6 | g |
| Distilled water | 152 | ml |
| Room temperature (about 20° C.) | | |
| Total Vol. | 186 | ml |
| Solution C | | |
| $AgNO_3$ | 170 | g |
| Distilled water | 109 | ml |
| Room temperature (about 20° C.) | | |
| Total Vol. | 143 | ml |

After 50 seconds, Solution A was adjusted to a VAg+110 mv with a bromide ion solution. The total precipitation time was approximately 22 minutes, i.e. until Solution C was completely added. Then Solution B addition was stopped. The final composition had a pH of 5.50 and a pAg of 8.41. The temperature of the reaction vessel was increased to 40° C. and the pH was adjusted to 3.5 with 1.5 N nitric acid. The supernatant was decanted and the coagulum was redispersed by adding $10^{-3}$ M lithium bromide solution to make a final weight of 1300 grams (pAg 7.70) and adjusting the composition to a pH of 6.50 with 2.0 M lithium hydroxide. This procedure was repeated twice and after removal of the final supernatant the concentrated coagulum (about 500 grams per silver mole) was adjusted to pH 6.5 and a pAg of 8.3 with vigorous stirring at 40° C. for 30 minutes to insure complete dispersal and ionic equilibrium before chill setting for storage. The resulting silver halide emulsion at 40° C. was mixed with 3 ml of a solvent mixture containing 87 grams of toluene, 4 grams of benzyl alcohol and 4% by weight poly(vinyl butyral) using an ultrasonic mixing means. The resulting composition was then combined with other components as described in Example 1 to provide a photothermographic element according to the invention.

The resulting photothermographic element was imagewise exposed to light to provide a developable latent image in the element. The image was developed by heating the element at 125° C. for 5 seconds. The developed image had a maximum density of 3.00 and a minimum density of 0.20.

EXAMPLE 3

The procedure described in Example 2 was repeated with the exception that one of the compounds designated as A–G was used as the solvent at 0.90 mole per mole of silver halide in place of the described concentration of benzyl alcohol.

| Compound | Name |
|---|---|
| A | benzyl alcohol |
| B | DL-α-methylbenzyl alcohol |
| C | o-phenoxybenzyl alcohol |
| D | m-(trifluoromethyl)benzyl alcohol |
| E | p-bromobenzyl alcohol |
| F | o-iodobenzyl alcohol |
| G | Sucrose |

The photothermographic element containing the described compounds was prepared with the silver halide as described in Example 2. The resulting photothermographic elements were each imagewise exposed for one-eighth second to a mercury light source through a graduated density step wedge to produce a developable latent image in the element. The image was developed by heating the element at 125° C. for 5 seconds in each instance. The sensitometric results for each of the compounds noted is given in following Table I:

TABLE I

| Compound | *Relative Speed | γ | Dmin | Dmax |
|---|---|---|---|---|
| None | 100 | 0.96 | 0.26 | 1.64 |
| A | 195 | 1.50 | 0.20 | 2.57 |
| B | 186 | 1.41 | 0.27 | 2.40 |
| C | 107 | 1.36 | 0.20 | 1.96 |
| D | 214 | 0.60 | 0.24 | 1.40 |
| E (comparative example) | FOGGED COMPLETELY | | | |
| F (comparative example) | 15.5 | 1.70 | 0.51 | 2.06 |
| G (comparative example) | 52 | 0.68 | 0.20 | 1.14 |

*Relative Speed measured at 0.30 above Dmin.

The data in Table I illustrates that Compounds B, C and D produce results similar to Compound A (benzyl alcohol). That is, the compounds produce increased relative speed and maximum density compared to the photothermographic element containing no benzyl alcohol. Compounds E, F and G produced detrimental relative speed results. Enhanced contrast was observed in photographic elements containing Compounds B and C.

EXAMPLE 4

The procedure described in Example 2 was repeated with the exception that one of the compounds designated 4A, 4H, 4I and 4J was used as the solvent at 0.90 mole per mole of silver halide in place of the described concentration of benzyl alcohol.

| Compound | Name |
|---|---|
| 4A | benzyl alcohol |
| 4H | p-methylbenzyl alcohol |
| 4I | p-methoxybenzyl alcohol |
| 4J | 2-phenoxyethanol |

The resulting coatings were imagewise exposed for $10^{-3}$ seconds to a zenon light source through a graduated density step wedge to produce a developable latent image in the exposed photothermographic element. The imagewise exposed photothermographic element was processed by heating the element at 125° C. for 5 seconds. A developed image was produced in each element. The sensitometric results were as follows:

TABLE II

| Compound | *Relative Speed | γ | Dmin | Dmax |
|---|---|---|---|---|
| None | 100 | 1.03 | 0.32 | 1.70 |
| A | 229 | 2.10 | 0.29 | 2.60 |
| H | 229 | 2.10 | 0.28 | 2.52 |
| I | 257 | 2.10 | 0.29 | 2.66 |
| J | 240 | 2.30 | 0.29 | 2.66 |

*Relative speed at 1.0 above Dmin.

Improvement in photographic speed, contrast, and maximum density with reduced minimum density was observed when comparing the results for Compounds 4A, 4H, 4I and 4J with the control. The use of benzyl alcohol and its derivatives in the described photothermographic material also provides a reduction in haze in the photothermographic layer of the element. The photothermographic element in each instance after processing is free of haze.

EXAMPLE 5

A photothermographic film containing no sensitizing dyes was prepared as follows:

(A) Preparation of silver behenate dispersion:

The following ingredients were combined and blended in the following order in a commercial homogenizer:

| | Component | Amount |
|---|---|---|
| 1. | Acetone | 250 ml |
| 2. | Toluene | 250 ml |
| 3. | Poly(vinyl butyral) (sold under the trade name "B-76" by Monsanto Co., U.S.A.) | 0.5 g |
| 4. | Basic alumina | 5 g |
| 5. | Behenic acid | 16 g |
| 6. | Lithium stearate | 3 g |
| 7. | Silver behenate | 42 g |
| 8. | Poly(vinyl butyral) | 29.5 g |

(B) Preparation of silver halide emulsion:

A silver bromoiodide gelatino emulsion at pH 6.5 and pAg 8.3 was melted at 50° C. The emulsion was chemically sensitized by means of sulfur and gold compound sensitizers and then held for 10 minutes at 50° C.

(C) Preparation of silver halide/polymer dispersion:

To a 100 ml beaker were added the following: 55 g of 4% by weight poly(vinyl butyral) (sold under the trade name "B-76" by Monsanto Co., U.S.A.) in a mixture of 52.8 g of toluene and 2.5 g of benzyl alcohol. This polymer solution was thoroughly mixed by ultrasonic mixing means with 13.1 g (0.02 mole) of the chemically sensitized silver halide gelatino emulsion at 50° C.

(D) Preparation of photothermographic composition and element:

The following components were mixed:

| | | Amount |
|---|---|---|
| 1. | 4% by weight poly(vinyl butyral) in toluene | 30 ml (25.3 g) |
| 2. | toluene | 9 ml (7.9 g) |
| 3. | 3-ethyl-2-thio-2,4-oxazolidenedione (0.1% by weight in acetone) (speed increasing addendum) | 0.4 ml (0.3 g) |
| 4. | surfactant (siloxane compound sold under the trade name "AF-70" by General Electric Co., U.S.A.) | 0.7 ml (0.5 g) |
| 5. | silver behenate dispersion (as described in A)) (oxidizing agent) | 80 ml (68 g) |

The components were stirred for one minute. Then 30 milliliters (27 g) of the silver halide/polymer dispersion (as described in C)) were added. The resulting composition was stirred and then the following components were added:

| | | |
|---|---|---|
| 1. | 2,6-dichloro-4-benzenesulfonamidophenol (5 g dissolved in 4.3 g of acetone. 9.2 g of toluene added to make 18.5 g (20 ml)) (reducing agent) | 10 ml (9.6 g) |
| 2. | 2-(tribromomethylsulfonyl)benzothiazole (1.0 g dissolved in 7.8 g of acetone and 8.6 g of toluene to make 17.4 g (20 ml)) (stabilizer precursor) | 6 ml (5.2 g) |

The resulting composition in the form of a melt was coated on a poly(ethylene terephthalate) film support at 12.0 ml/ft$^2$ (per 929 square centimeters) (about 0.0129 ml/cm$^2$). The film support contained a blue antihalation dye.

(E) Overcoat preparation:

The following components were mixed to prepare an overcoat composition:

| | | Amount |
|---|---|---|
| 1. | Cellulose acetate | 32 g |
| 2. | Acetone-methylene chloride (1:1 by volume) | 1000 ml |
| 3. | 2-Butanone | 100 ml |

The composition, after mixing, was coated at 3.7 ml/ft$^2$ (per 929 square centimeters) on the layer containing the silver bromoiodide of the film from (D).

The resulting photothermographic film was found to be useful as an aerial print film. A developed image was produced upon imagewise exposure to light to produce a developable latent image and thermal processing.

EXAMPLE 6

A photothermographic film similar to that described in Example 5 was prepared with the exception that the layer containing silver bromoiodide also contained the following two sensitizing dyes:

3-ethyl-5-(3-ethyl-2-benzoxazolylidene)-1-phenyl-2-thiohydantoin (0.50 ml of 0.05% by weight solution containing 1.36 mg of dye in 1:9 by volume acetone:-toluene added to composition prior to coating)

anhydro-3-ethyl-9-methyl-3'-(3-sulfobutyl)-thiacarbocyanine hydroxide (3ml of 0.01% by weight solution containing 5 mg of dye/3 ml solution in 1:1 by volume methanol:toluene added to composition prior to coating)

The resulting photothermographic film was imagewise exposed to light to produce a developable latent image and then thermally processed to produce a developed image.

The invention has been described in detail with particular reference to preferred embodiments thereof, but it will be understood that variations and modifications can be effected within the spirit and scope of the invention.

What is claimed is:

1. In a photothermographic silver halide composition capable of being coated on a support comprising a hydrophilic photosensitive silver halide emulsion containing a gelatino peptizer with an organic solvent mixture, a hydrophobic binder and an oxidation-reduction image-forming composition comprising (i) a silver salt of a long-chain fatty acid with (ii) an organic reducing agent, the improvement wherein said composition comprises, as said solvent mixture, a combination of (A) an alcohol photographic speed-increasing solvent which is a compound selected from the group consisting of benzyl alcohol photographic speed-increasing solvents and 2-phenoxyethanol photographic speed-increasing solvents with (B) an aromatic hydrocarbon solvent that is compatible with said alcohol solvent.

2. A photothermographic silver halide composition as in claim 1 wherein the concentration of the gelatino peptizer is within the range of about 5 g to about 20 g of gelatin per mole of silver in said silver halide emulsion.

3. A photothermographic silver halide composition as in claim 1 wherein said alcohol solvent consists essentially of 2-phenoxyethanol.

4. A photothermographic silver halide composition as in claim 1 wherein said alcohol solvent consists essentially of benzyl alcohol.

5. A photothermographic silver halide composition as in claim 1 wherein said alcohol solvent consists essentially of DL-α-methylbenzyl alcohol.

6. A photothermographic silver halide composition as in claim 1 wherein said alcohol solvent consists essentially of m-(trifluoromethyl)benzyl alcohol.

7. A photothermographic silver halide composition as in claim 1 wherein said hydrocarbon solvent consists essentially of toluene.

8. A photothermographic silver halide composition as in claim 1 comprising a concentration of said alcohol solvent that is within the range of about 0.25 mole to about 2.0 moles of said alcohol solvent per mole of photosensitive silver halide in said emulsion; and, the ratio by volume of said alcohol solvent to said hydrocarbon solvent is within the range of about 1:50 to 1:200.

9. A photothermographic silver halide composition as in claim 1 wherein said solvent mixture also comprises up to 10% by weight poly(vinyl butyral).

10. In a photothermographic silver halide composition capable of being coated on a support comprising an aqueous photosensitive silver halide emulsion containing a gelatino peptizer with an organic solvent mixture, a hydrophobic polymeric binder consisting essentially of poly(vinyl butyral) and an oxidation-reduction image-forming combination comprising (i) a silver salt of a long-chain fatty acid consisting essentially of silver behenate with an organic reducing agent consisting essentially of a sulfonamidophenol, the improvement wherein said composition comprises, as said solvent mixture, a combination of 2-phenoxyethanol with toluene and up to 10% by weight poly(vinyl butyral).

11. In a photothermographic silver halide composition capable of being coated on a support comprising (I) an aqueous photosensitive silver halide emulsion containing a gelatino peptizer with (II) comprising an organic solvent mixture, (a) a hydrophobic polymeric binder consisting essentially of poly(vinyl butyral) and (b) an oxidation-reduction image-forming combination comprising (i) a silver salt of a long-chain fatty acid consisting essentially of silver behenate with (ii) an organic reducing agent consisting essentially of a sulfonamidophenol, the improvement wherein said composition comprises, as said solvent mixture, a combination of benzyl alcohol with toluene and up to 10% by weight poly(vinyl butyral).

12. In a method of preparing a photothermographic element comprising very thoroughly mixing (I) a hydrophilic photosensitive silver halide emulsion comprising a gelatino peptizer with (II) an organic solvent mixture and then very thoroughly mixing the resulting product with (III) comprising (a) a hydrophobic binder and (b) an oxidation-reduction image-forming composition comprising (i) a silver salt of a long-chain fatty acid with (ii) an organic reducing agent, and coating the resulting composition onto a support, the improvement wherein said method comprises said mixing of (I) with (II) wherein (II) comprises (A) an alcohol photographic speed-increasing solvent with (B) an aromatic hydrocarbon solvent that is compatible with said alcohol solvent and (C) 0 to 10% by weight of (II) of a hydrophobic binder.

13. A method as in claim 12 wherein said alcohol solvent consists essentially of benzyl alcohol.

14. A method as in claim 12 wherein said alcohol solvent consists essentially of DL-α-methylbenzyl alcohol.

15. In a method as in claim 12 wherein said alcohol solvent consists essentially of m-(trifluoromethyl)benzyl alcohol.

16. A method as in claim 12 wherein said alcohol solvent consists essentially of 2-phenoxyethanol.

17. In a method as in claim 12 wherein said hydrocarbon solvent consists essentially of toluene.

18. A method as in claim 12 wherein the concentration of said alcohol solvent is within the range of about 0.25 mole to about 2.0 moles of said alcohol solvent per mole of photosensitive silver halide; and, the ratio by volume of said alcohol solvent to said hydrocarbon solvent prior to said coating is within the range of about 1:50 to 1:200.

19. In a method of preparing a photothermographic element comprising ultrasonic wave mixing (I) a hydrophilic photosensitive silver halide emulsion comprising a gelatino peptizer with (II) an organic solvent mixture and then ultrasonic wave mixing the resulting product with (III) comprising (a) poly(vinyl butyral) binder and (b) an oxidation-reduction image-forming composition comprising (i) silver behenate with (ii) a sulfonamidophenol reducing agent, and coating the resulting composition onto a support, the improvement wherein said method comprises said mixing of (I) with (II) wherein (II) comprises (A) benzyl alcohol with (B) toluene and (C) 0 to 10% by weight poly(vinyl butyral).

20. In a method of preparing a photothermographic element comprising ultrasonic wave mixing (I) a hydrophilic photosensitive silver halide emulsion comprising a gelatino peptizer with (II) an organic solvent mixture and then ultrasonic wave mixing the resulting product with (III) comprising (a) poly(vinyl butyral) binder and (b) an oxidation-reduction image-forming composition comprising (i) silver behenate with (ii) a sulfonamidophenol reducing agent and coating the resulting composition onto a support, the improvement wherein said method comprises said mixing of (I) with (II) wherein (II) comprises (A) 2-phenoxyethanol with (B) toluene and (C) 0 to 10% by weight poly(vinyl butyral).

21. A photothermographic silver halide composition prepared by the process defined in claim 1.

22. A photothermographic silver halide composition prepared by the process defined in claim 10.

23. A photothermographic silver halide composition prepared by the process defined in claim 11.

24. A photothermographic element prepared by the process defined in claim 12.

25. A photothermographic element prepared by the process defined in claim 19.

26. A photothermographic element prepared by the process defined in claim 20.

* * * * *